US008074430B2

(12) United States Patent
Disrud

(10) Patent No.: US 8,074,430 B2
(45) Date of Patent: Dec. 13, 2011

(54) TWIN LAYER PACKAGING MACHINE

(75) Inventor: Jeff A. Disrud, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 261 days.

(21) Appl. No.: 12/487,261

(22) Filed: Jun. 18, 2009

(65) Prior Publication Data

US 2009/0313953 A1 Dec. 24, 2009

Related U.S. Application Data

(60) Provisional application No. 61/073,854, filed on Jun. 19, 2008.

(51) Int. Cl.
*B65B 35/50* (2006.01)

(52) U.S. Cl. ..... 53/447; 53/540; 53/153

(58) Field of Classification Search ..... 53/447, 53/475, 566, 153, 540, 252, 152, 534, 543, 53/154; 198/429, 430
See application file for complete search history.

(56) References Cited

U.S. PATENT DOCUMENTS

| | | | | |
|---|---|---|---|---|
| 3,323,275 | A * | 6/1967 | Kingsbury et al. | 53/462 |
| 3,821,874 | A * | 7/1974 | Jones | 53/449 |
| 4,875,323 | A * | 10/1989 | Craighead | 53/48.1 |
| 4,936,077 | A * | 6/1990 | Langen et al. | 53/543 |
| 5,237,795 | A * | 8/1993 | Cheney et al. | 53/154 |
| 5,388,389 | A * | 2/1995 | Tisma | 53/473 |
| 5,437,143 | A * | 8/1995 | Culpepper et al. | 53/445 |
| 5,450,708 | A * | 9/1995 | Lashyro | 53/399 |
| 5,546,734 | A * | 8/1996 | Moncrief et al. | 53/534 |
| 5,727,365 | A | 3/1998 | Lashyro et al. | |
| 5,758,474 | A | 6/1998 | Ziegler | |
| 6,308,502 | B1 | 10/2001 | Olson et al. | |

FOREIGN PATENT DOCUMENTS

EP 0 717 702 B1 12/1998

OTHER PUBLICATIONS

International Search Report and Written Opinion—PCT/US2009/047783.

* cited by examiner

*Primary Examiner* — Sameh H. Tawfik
(74) *Attorney, Agent, or Firm* — Womble Carlyle Sandridge & Rice, LLP

(57) ABSTRACT

A twin layer packaging machine is disclosed for packing cartons with articles such as beverage cans in two layers, a top layer overlying a bottom layer. The packaging machine has a selector flight defining selector bays, a can flight defining can bays, and a carton flight transporting cartons to be packed, all synchronously movable with each other. A single infeed assembly at the upstream end of the machine directs first groups of cans into selector bays on the selector flight, sweeps them into adjacent can bays, and directs second groups of cans into the same selector bays, all on the same level. The selector flight and the second groups of cans in its selector bays then ramps up to an elevated level, from where the second groups of cans are swept from the selector bays into the adjacent can bays atop the already loaded first groups of cans. The thus staged twin layer cans are then pushed into open cartons on the carton flight, whereupon the cartons are closed and sealed.

4 Claims, 2 Drawing Sheets

TWIN LAYER PACKAGING MACHINE

CROSS-REFERENCE TO RELATED APPLICATIONS

This application claims the benefit of Provisional Application No. 61/073,854, filed Jun. 19, 2008, the entire contents of which is hereby incorporated by reference.

TECHNICAL FIELD

This disclosure relates generally to packaging machines and more particularly to twin layer packaging machines for packing into a carton two layers of upright articles such as beverage cans, one layer overlying the other.

BACKGROUND

When packaging articles such as soft drink and beer cans into cartons, it sometimes is desirable to group the articles in two layers within the carton, with an upper layer of upright articles overlying a lower layer of upright articles. It is common to separate the layers with a paperboard divider pad on which the upper layer rests. Such a packaging configuration is sometimes referred to as "twin layer packaging." Packaging machines for obtaining twin layer packaging of articles are known, one such machine being exemplified in U.S. Pat. No. 5,758,474 of Ziegler, which is commonly owned by the assignee of the present application. Such packaging machines generally comprise an infeed assembly that progressively directs articles in groups into the bays of a synchronously moving conveyor flight. The infeed assembly includes an upstream infeed belt and associated infeed lanes for directing the bottom layer of articles into the bays. A separate downstream infeed belt and associated infeed lanes, which are disposed at an elevated level relative to the upstream infeed belt and lanes, progressively directs the top layer of articles into the bays atop the already loaded bottom layer of articles. The articles thus are staged in two overlying layers in the bays and subsequently are pushed with a pusher assembly into an open carton on an adjacent and synchronized carton flight. The cartons are then closed to complete the packaging process. The use of separate infeed assemblies, one for the bottom layer of articles and one for the top, increases the complexity of these packaging machines and takes up valuable additional space within them.

A need exists for an improved packaging machine for obtaining twin layer packaging of articles such as beverage cans and it is to the provision of such a packaging machine that the present invention is primarily directed.

DETAILED DESCRIPTION

Figure 1:
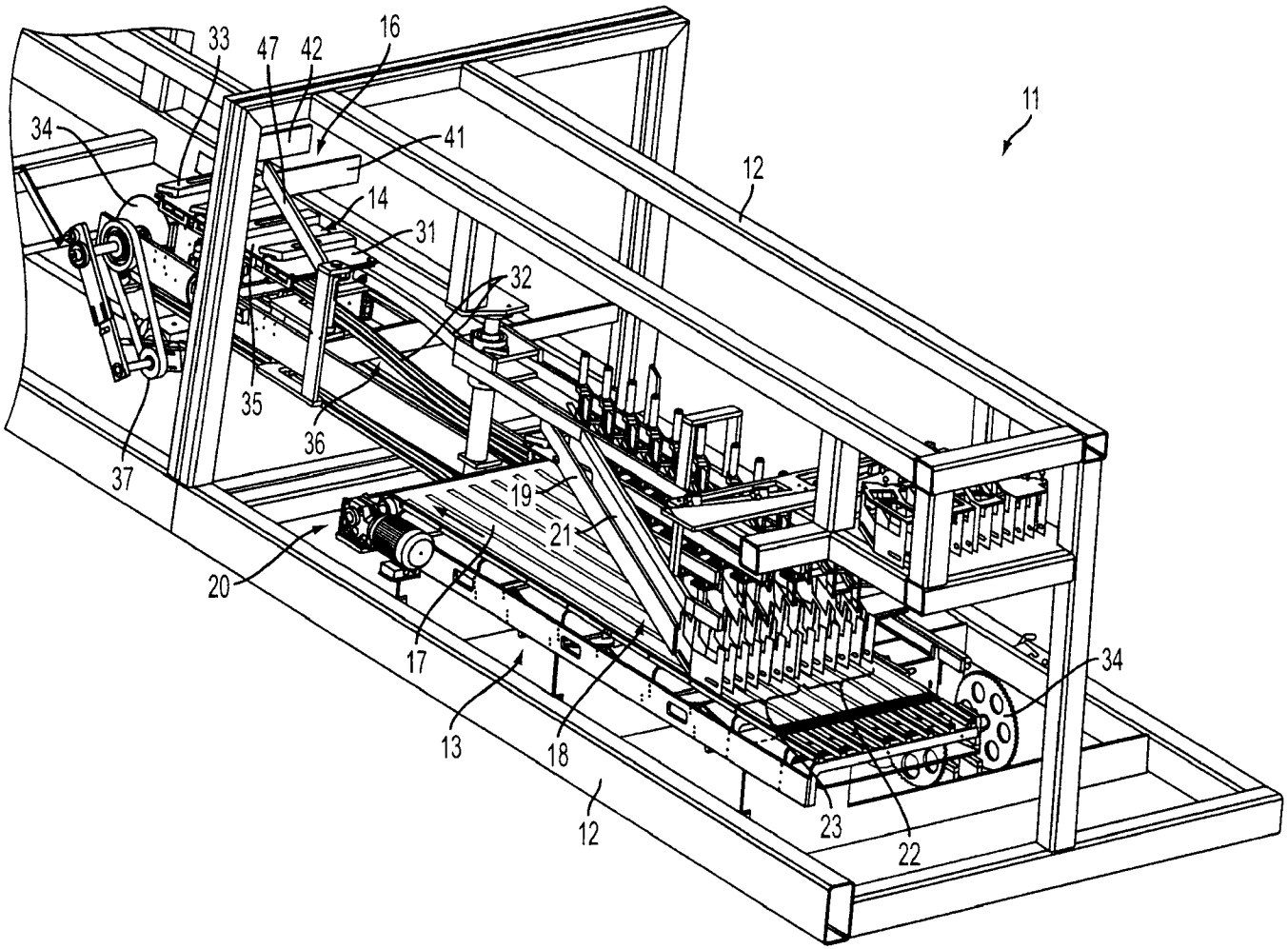
FIG. 1 is a perspective view of a portion of a packaging machine that embodies principles of the invention in one preferred form.

Referring to the drawing figures, FIG. 1 is a perspective illustration of a twin layer packaging machine according to the present disclosure. Some elements are omitted and/or only partially illustrated in FIG. 1 in the interest of clarity. The twin layer packaging machine 11 comprises a frame 12 configured to support the various functioning components of the machine. An infeed section 13 is mounted to the frame at an upstream end of the machine and comprises a single infeed belt 17 that is driven by a motor and drive train 20 so that the infeed belt 17 moves in the direction of the arrow in FIG. 1. An article guide assembly 18 is suspended just above the surface of the infeed belt 17 and generally includes a plurality of spaced guide rails 19 that define between themselves a corresponding plurality of infeed lanes 21. The guide rails 19 are spaced such that the infeed lanes 21 are slightly wider than articles, commonly beverage containers, that are to be packaged. The infeed lanes are arranged into a group of interior lanes 22 and a group of exterior lanes 23. In the illustrated embodiment, there are six infeed lanes in each group; however, the machine may be selectively configured with more or fewer than six lanes in each group depending upon the number of articles to be packaged in a single carton. As discussed in more detail below, the interior lanes accommodate articles that are to be packaged on the bottom layer of the twin layer package while the exterior lanes accommodate articles that are to be packaged in the top layer overlying the bottom layer. The interior and exterior lanes are all part of the same infeed assembly, all make use of a single infeed belt, and all are on a single level.

A continuous conveyor referred to as a selector flight 14 is disposed adjacent to the infeed section and extends further downstream therefrom. In general, the selector flight comprises a selector bed 31 made up of a plurality of side-by-side mutually articulated selector plates that move to the left in FIG. 1 along a pair of selector bed rails 32. The selector bed is driven by flight chains that extend around appropriate sprockets 34 and are driven by a drive train, generally indicated at 47. Selector wedges 33 are mounted to the selector bed and define between themselves a plurality of selector bays 35 sized to accommodate a grouping of articles to be packaged. Various sizes of selector wedges may be mounted to the selector bed as needed to define selector bays sized to accommodate a desired number of articles such as, for example, a three wide by six deep array of beverage cans. Significantly, the selector flight 14 is formed with a ramped section 36 just downstream of the infeed section 13. The ramped section 36 progressively elevates the selector bed as it moves, and thus elevates articles grouped in the selector bays, from a lower level adjacent the infeed section 13 to a raised upper level downstream of the infeed section.

As detailed below, from the lower level of the selector bed, groups of articles are pushed by a lower fixed pusher rail 46 (FIG. 2) from the selector bays into adjacent can or article bays where they are thus staged to become the bottom layer of articles in a carton. A paperboard divider pad is then placed atop the bottom layer. Then, from the upper level of the selector bed, groups of articles are pushed or swept by a fixed pusher rail 47 from the now raised selector bays into adjacent can bays atop the already loaded bottom layer and divider pad, where they are thus staged to become the top layer of articles in a carton. The vertical position of the upper level relative to the lower level is adjustable to accommodate the height of the articles, such as beverage cans, to be packaged. With the articles staged in two overlying layers within the can bays, they can then be moved into open cartons 51 on an adjacent synchronous carton flight 15 (see FIG. 2).

Figure 2:
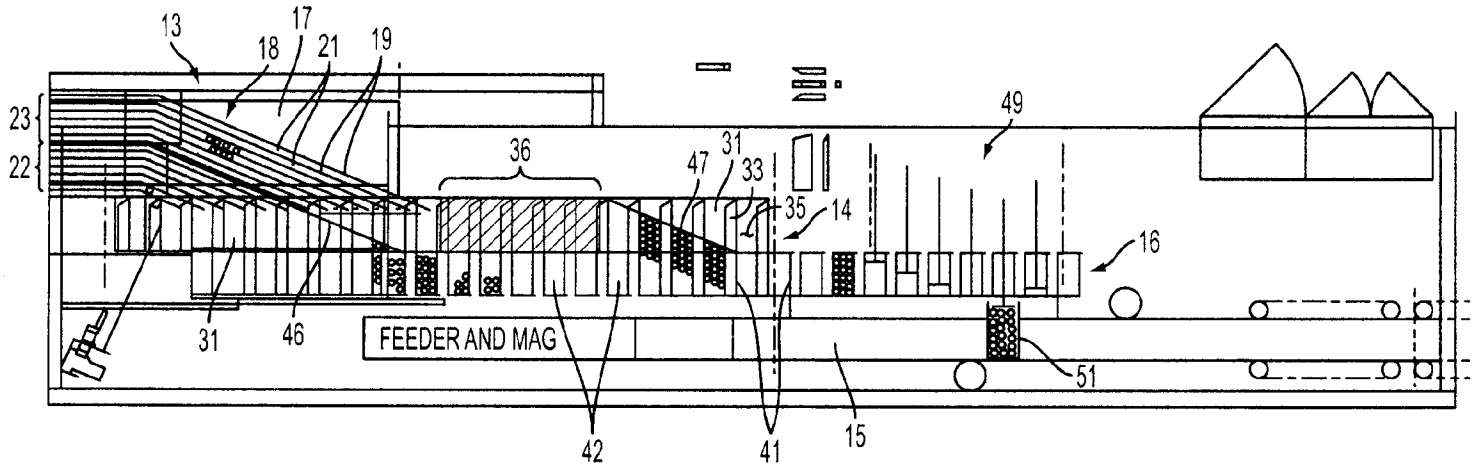
FIG. 2 is a top plan view of the packaging machine illustrated in FIG. 1.
Figure 3:
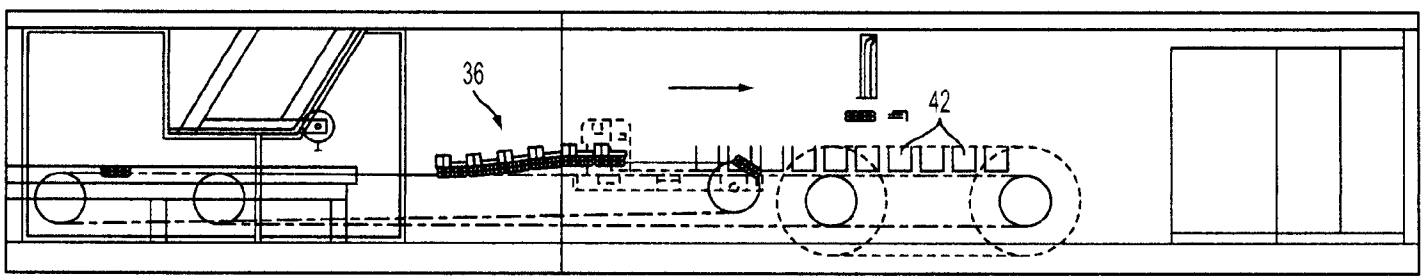
FIG. 3 is a side elevation of the packaging machine illustrated in FIGS. 1 and 2.

FIG. 2 is a plan view of the twin layer packaging machine of this disclosure illustrating its operation from a different and perhaps more instructive perspective. Articles such as beverage cans are conveyed en masse to the upstream end of the infeed belt 17 on the extreme left in FIG. 2. From there, the cans are directed into the infeed lanes 21 of the product guide assembly 18, where, because of the widths of the infeed lanes, they assume, in each lane, a single file configuration. Cans are directed into both the interior group of lanes 22 and the exterior group of lanes 23. Movement of the infeed belt 17 advances the cans along their respective infeed lanes toward the adjacent and synchronously moving selector bays 31. As a consequence, cans from the interior group of lanes fill the selector bays 31 to the left of the fixed pusher rail 46. Continued movement of the selector bed to the right causes these cans to be swept by the pusher rail 46 out of their selector bays and into adjacent synchronously moving can bays 42 disposed along the can flight 16. These groups of cans are then staged in the can bays to become the bottom layer of cans in a carton and, subsequently, a divider pad, which may be made of paperboard, can be placed atop these cans.

As the first groups of cans are swept progressively out of the selector bays and into can bays by fixed pusher rail 46, the emptying selector bays are progressively refilled, each with another or second group of cans, from the exterior group of lanes 23. After being thus refilled, these second groups of cans are conveyed along the selector flight up the ramped section 36 thereof to an elevated position that has been pre-set to be just above the bottom layer of cans and divider pads in the adjacent and synchronously moving can bays 42. Once at this elevated level, the second groups of cans in the selector bays encounter the upper fixed pusher rail 47, which progressively sweeps the groups of cans out of the selector bays and into the adjacent synchronous can bays on top of the bottom layer of cans and divider pad already in the can bays. As a result, the can bays become loaded with a bottom group or layer of cans and a top group or layer of cans separated by a divider pad. The cans are thus staged in the can bays for packaging into cartons in this twin layer configuration. Further downstream, then, pusher rods 49 push the staged twin layered cans from the can bays 42 into open cartons 51 on the adjacent and synchronously moving carton flight 15 in the traditional manner. The cartons then proceed to downstream portions of the packaging machine, where they are closed and sealed and further prepared for distribution.

The just described twin layer packaging machine and methodology represent a distinct improvement over prior art twin layer packaging machines. For instance, both lower and upper layers of articles such as beverage cans are loaded onto the selector flight and into selector bays with a single relatively short infeed section consisting of a single infeed belt and a single array of infeed lanes, all disposed at a single level in the machine. This contrasts with prior art machines, which commonly employ two infeed sections, one for the lower layer of cans and another downstream from and raised relative to the first for the upper layer of cans. This duplication renders the old machines more complex, more expensive to construct and maintain, and more prone to jams and breakdown. Further, the elimination of a second infeed section for the upper layer of cans frees up significant space within the packaging machine, making changeover for different packaging configurations and maintenance significantly simpler and less complicated.

This disclosure has included certain preferred embodiments that represent the best mode known to the inventor of carrying out the invention encompassed herein. However, the invention is not limited, circumscribed, or defined solely by the embodiments disclosed herein, but instead is defined and encompassed only by the claims.

What is claimed is:

1. A twin layer packaging machine having an upstream end and a downstream end and comprising:

a selector flight movable toward the downstream end of the packaging machine and having a plurality of selector bays;

an infeed section at an upstream end of the packaging machine for loading the selector bays with groups of articles to be packaged, the infeed section having an infeed belt, first guide rails defining a first set of infeed lanes for loading selector bays with first groups of articles to be packaged, and second guide rails defining a second set of infeed lanes on a same level as the first set of infeed lanes for loading selector bays with second groups of articles to be packaged;

a ramped section of the selector flight downstream of the second set of infeed lanes that carries the second groups of articles to an elevated level with respect to the first groups of articles;

a staging mechanism for positioning the second group of articles atop the first groups of articles in a twin layer configuration; and a loading mechanism for moving the staged groups of articles into a carton.

2. A twin layer packaging machine as claimed in claim 1 and wherein the staging mechanism comprises:

a can flight adjacent the selector flight and movable synchronously therewith toward the downstream end of the packaging machine, the can flight defining a plurality of can bays substantially aligned with the selector bays of the selector flight;

a first pusher rail for moving first groups of articles from selector bays into adjacent can bays; and a second pusher rail at the elevated level of the selector flight for moving second groups of articles from the elevated selector bays into adjacent can bays atop first groups of articles.

3. A twin layer packaging machine as claimed in claim 2 and wherein said loading mechanism comprises a carton flight adjacent to the can flight and movable synchronously therewith and configured to carry a plurality of cartons aligned with the can bays of the can flight, and a pusher assembly configured to push staged articles from can bays into adjacent cartons.

4. A twin layer packaging machine as claimed in claim 3 and wherein the first pusher rail is configured and positioned to move first groups of articles from selector bays into adjacent can bays before second groups of articles are loaded into the same selector bays from the second set of infeed lanes.

* * * * *